US010390566B2

(12) United States Patent
Hu et al.

(10) Patent No.: US 10,390,566 B2
(45) Date of Patent: Aug. 27, 2019

(54) HEATING DEVICE FOR ELECTRONIC CIGARETTE AND ATOMIZER HAVING SAME

(71) Applicant: Shenzhen First Union Technology Co., Ltd., Shenzhen, Guangdong Province (CN)

(72) Inventors: Shuyun Hu, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/663,798

(22) Filed: Jul. 30, 2017

(65) Prior Publication Data

US 2017/0325510 A1 Nov. 16, 2017

(30) Foreign Application Priority Data

Jul. 29, 2016 (CN) ..... 2016 2 0811709 U

(51) Int. Cl.

| | |
|---|---|
| ***A24F 13/00*** | (2006.01) |
| ***A24F 47/00*** | (2006.01) |
| ***H05B 3/46*** | (2006.01) |

(52) U.S. Cl.

CPC ..... *A24F 47/008* (2013.01); *H05B 3/46* (2013.01); *H05B 2203/021* (2013.01)

(58) Field of Classification Search

CPC ..... A24F 47/008
USPC ..... 131/328–329
See application file for complete search history.

(56) References Cited

U.S. PATENT DOCUMENTS

2015/0181937 A1* 7/2015 Dubief ..... A24F 47/008 131/329

* cited by examiner

*Primary Examiner* — Phuong K Dinh
(74) *Attorney, Agent, or Firm* — Cheng-Ju Chiang

(57) ABSTRACT

The present disclosure relates to a heating device for an electronic cigarette. The heating device includes a heating part, a first conductive part, and a second electrically conductive part. The heating part has a hollow metallic tube wound in a spiral form. The first conductive part is electrically connected to a first end of the metallic tube. The second electrically conductive part is electrically connected to an opposite second end of the metallic tube.

12 Claims, 7 Drawing Sheets

HEATING DEVICE FOR ELECTRONIC CIGARETTE AND ATOMIZER HAVING SAME

TECHNICAL FIELD

The present invention relates to electronic cigarettes, and particularly to a heating device for an electronic cigarette, and an atomizer using same.

BACKGROUND ART

In a typical electronic cigarette, a heating device includes a solid heating wire. However, a surface area of the heating wire is small, and accordingly, a contact surface between the heating wire and a liquid conducting body is small. Therefore, an atomizing efficiency of the electronic cigarette is low.

What are needed, therefore, are a heating device and an atomizer having same, which can overcome the above shortcomings.

SUMMARY

The present disclosure relates to a heating device for an electronic cigarette. The heating device includes a heating part, a first conductive part, and a second electrically conductive part. The heating part has a hollow metallic tube wound in a spiral form. The first conductive part is electrically connected to a first end of the metallic tube. The second electrically conductive part is electrically connected to an opposite second end of the metallic tube.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
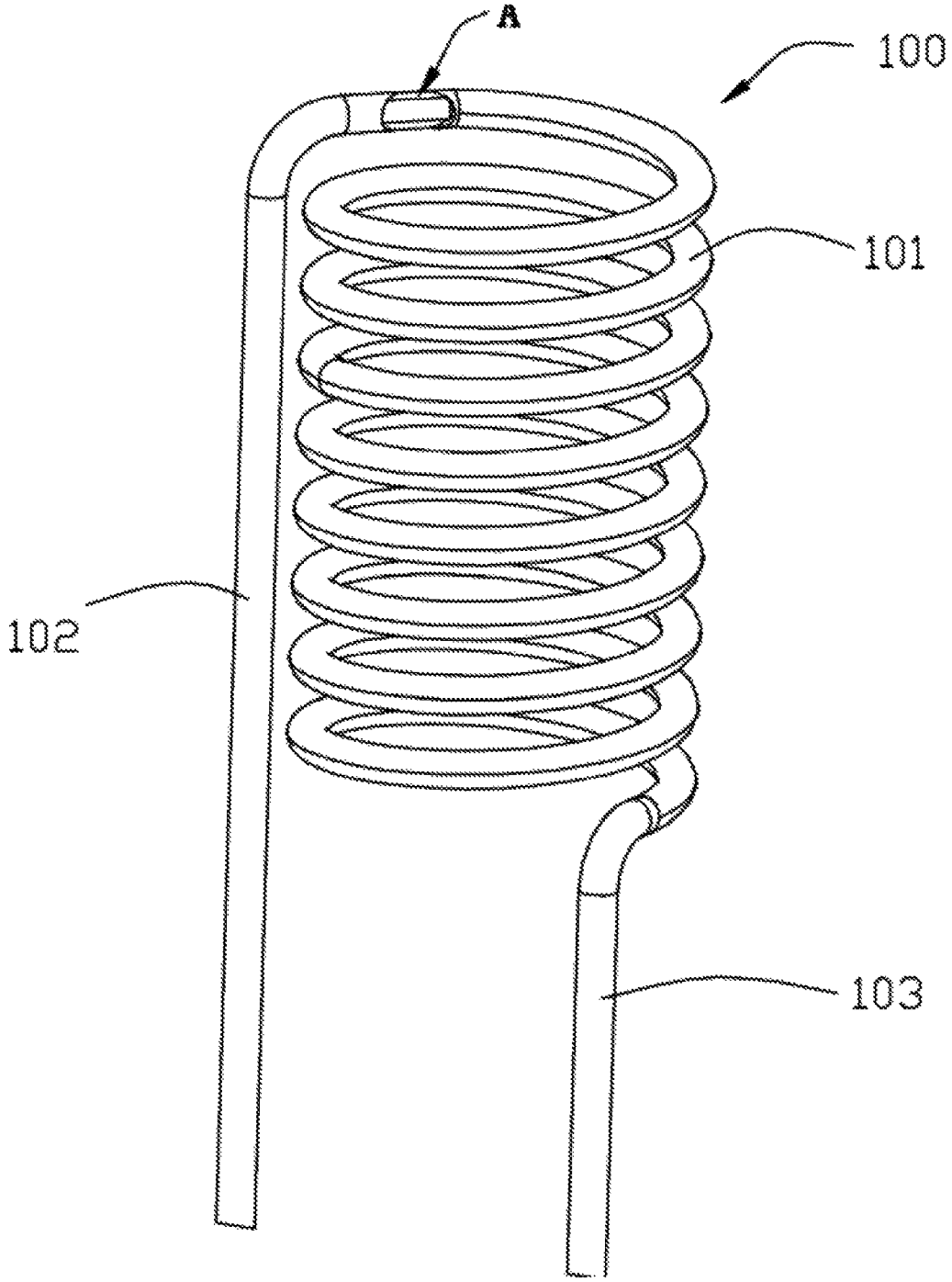
FIG. 1 is a perspective view of a heating device according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, a heating device 100 is shown. The heating device 100 includes a heating part 101, a first electrically conductive part 102 and a second electrically conductive part 103. The first and the second conductive parts 102, 103 are connected to two ends of the heating part 101. The heating part 101 is a hollow metallic tube (as seen in part A of FIG. 1), and is wound to form a spiral shape. In the present embodiment, the heating part 101 is made of alloying metal. When the heating part 101 is used in an electronic cigarette, a contact surface between the heating part 101 and a liquid conducting body of the electronic cigarette is increased, thus increasing an atomizing efficiency. Quite usefully, the heating part 101 is made of type 316L stainless steel. The first and the second conductive parts 102, 103 are welded to two ends of the heating part 101, and configured for connecting to electrodes of a power supply.

Figure 2:
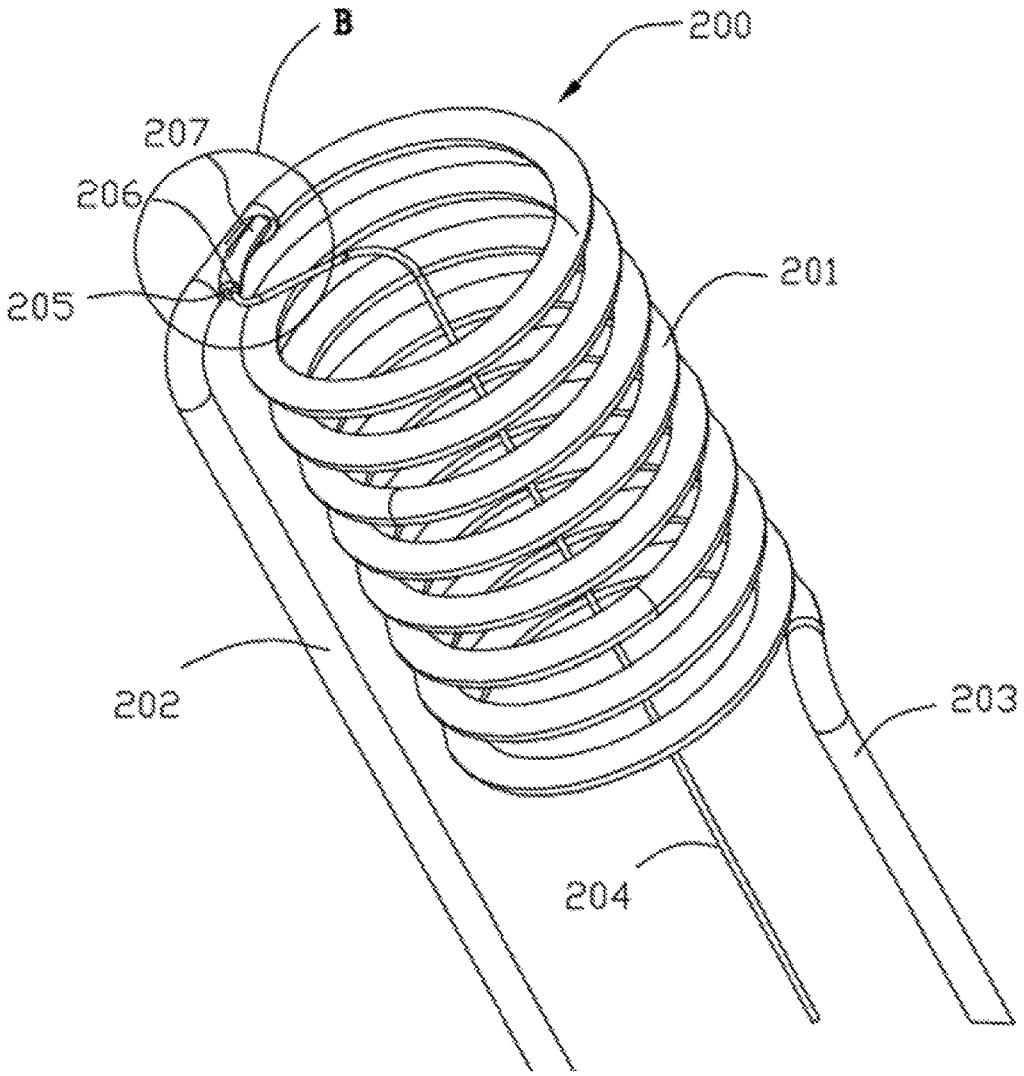
FIG. 2 is a perspective view of a heating device according to a second embodiment.
Figure 3:
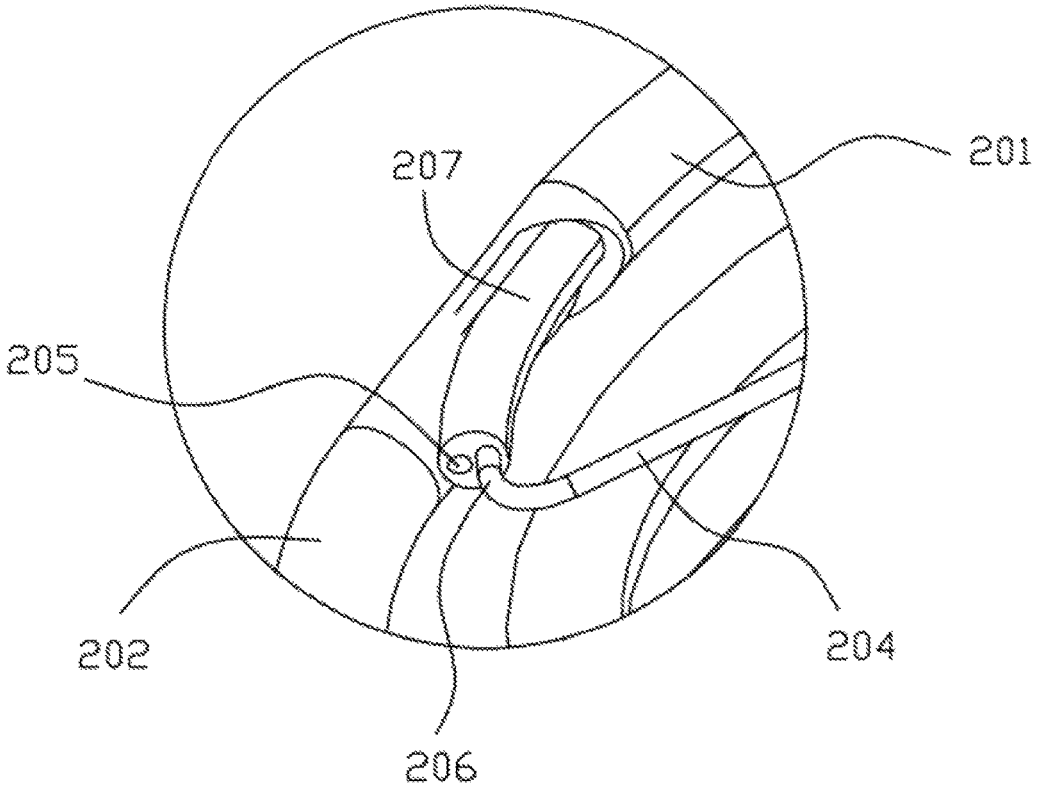
FIG. 3 is an enlarged view of area B of FIG. 2.
Figure 4:
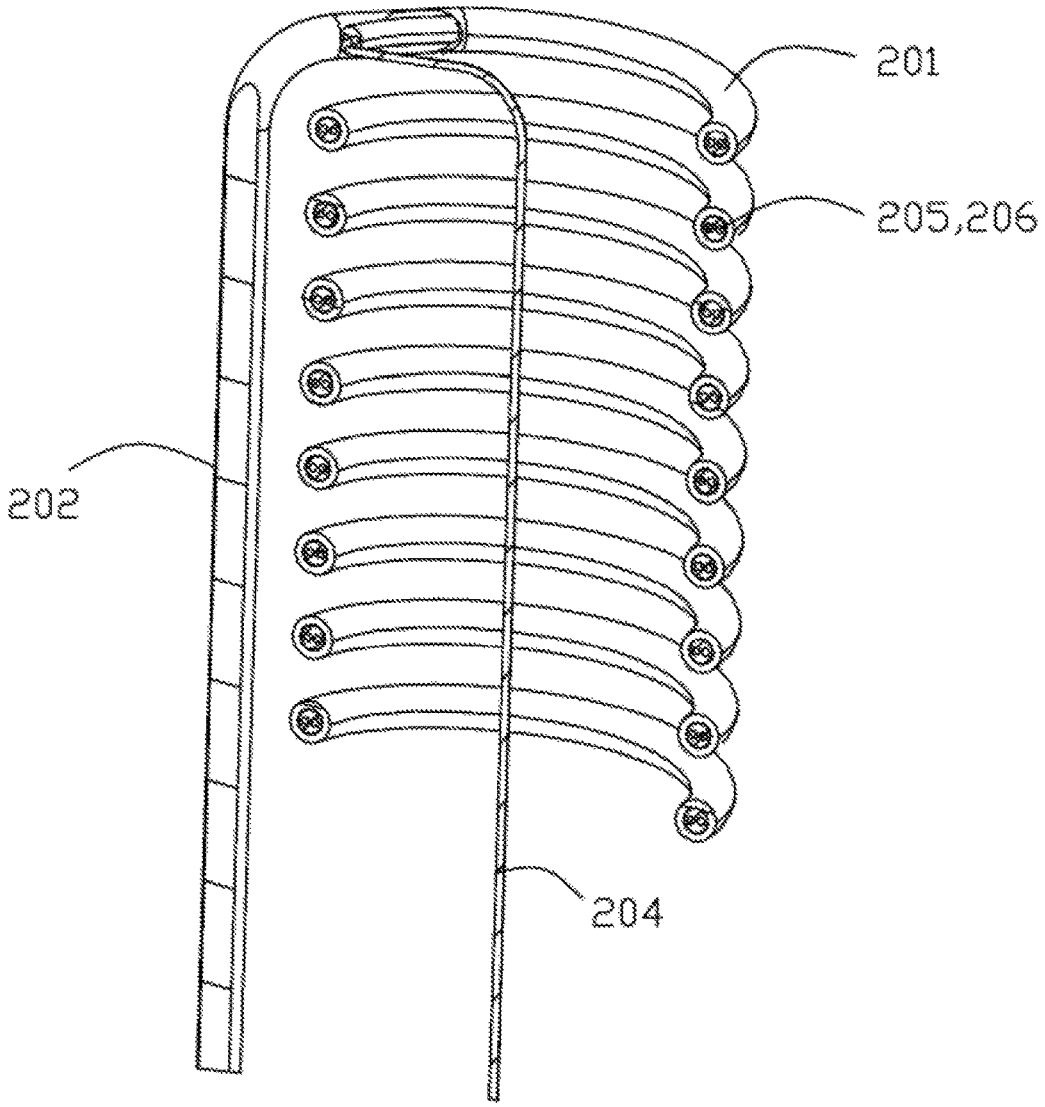
FIG. 4 is a longitudinal cutaway view of the heating device of FIG. 2.

Referring to FIGS. 2-4, a heating device 200 is similar to the heating device 100. The heating device 200 includes a heating part 201, a first conductive part 202, and a second conductive part 203. A temperature sensor is arranged in the heating part 201. The temperature sensor is adjacent to an external surface of the heating part 201, and accordingly, can detect a temperature of the heating part 201 precisely. An insulating medium 207 is filled between the temperature sensor and the heating part 201, so that the temperature sensor is insulated from the heating part 201. Quite usefully, in the present embodiment, the insulating medium 207 is made of magnesium oxide.

Quite usefully, the temperature sensor includes two thermocouple wires 205, 206. The two thermocouple wires 205 are connected with each other in one end, and arranged side by side in the heating part 201. The thermocouple wires 205, 206 are insulated from each other by the insulating medium 207. The temperature sensor can detects a temperature of the heating part 201, and sends a temperature signal to a controller of the electronic cigarette. The controller can keep a constant heating temperature of the heating device 200 based on the temperature signal.

An end of one of the thermocouple wires 205, 206 is connected to the first or the second conductive parts 202, 203, while an end of the other of the thermocouple wires 205, 206 is connected with a signal end 204. The signal end 204 passes through the metallic tube and through a hollow space of the heating part 201. Referring to FIG. 3, the thermocouple wires 205, 206 are wrapped by insulating medium. An end of the thermocouple wire 205 is welded to the first conductive part 202 as a common electrode, while an end of the thermocouple wire 206 is connected to the signal end 204. The signal end 204 is connected to a controller.

Figure 5:
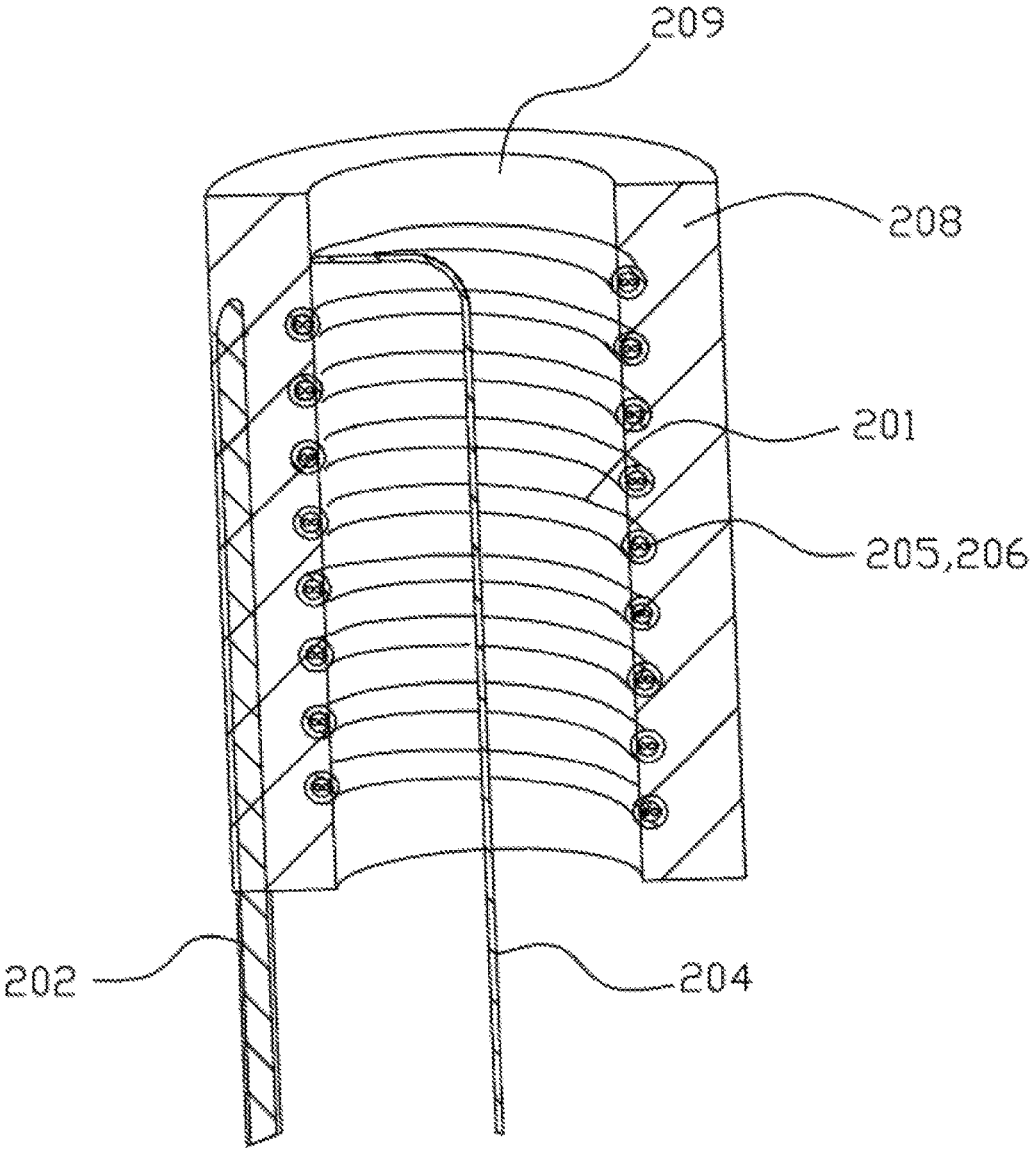
FIG. 5 is a perspective view of a heating device according to a third embodiment.

Quite usefully, referring to FIG. 5, the heating device 200 (or the heating device 100) further includes a porous ceramic body 208. The porous ceramic body 208 defines a chamber 209 extending through the porous ceramic body 208. The heating part 201 is arranged in the chamber 209, and is sintered with the porous ceramic body 208 integrally. Due to the porous structure, tobacco liquid can permeate from an outer surface of the porous ceramic body 208 to an inner surface, and is heated by the heating part 201 to form aerosol. The aerosol is expelled via the chamber 209.

Figure 6:
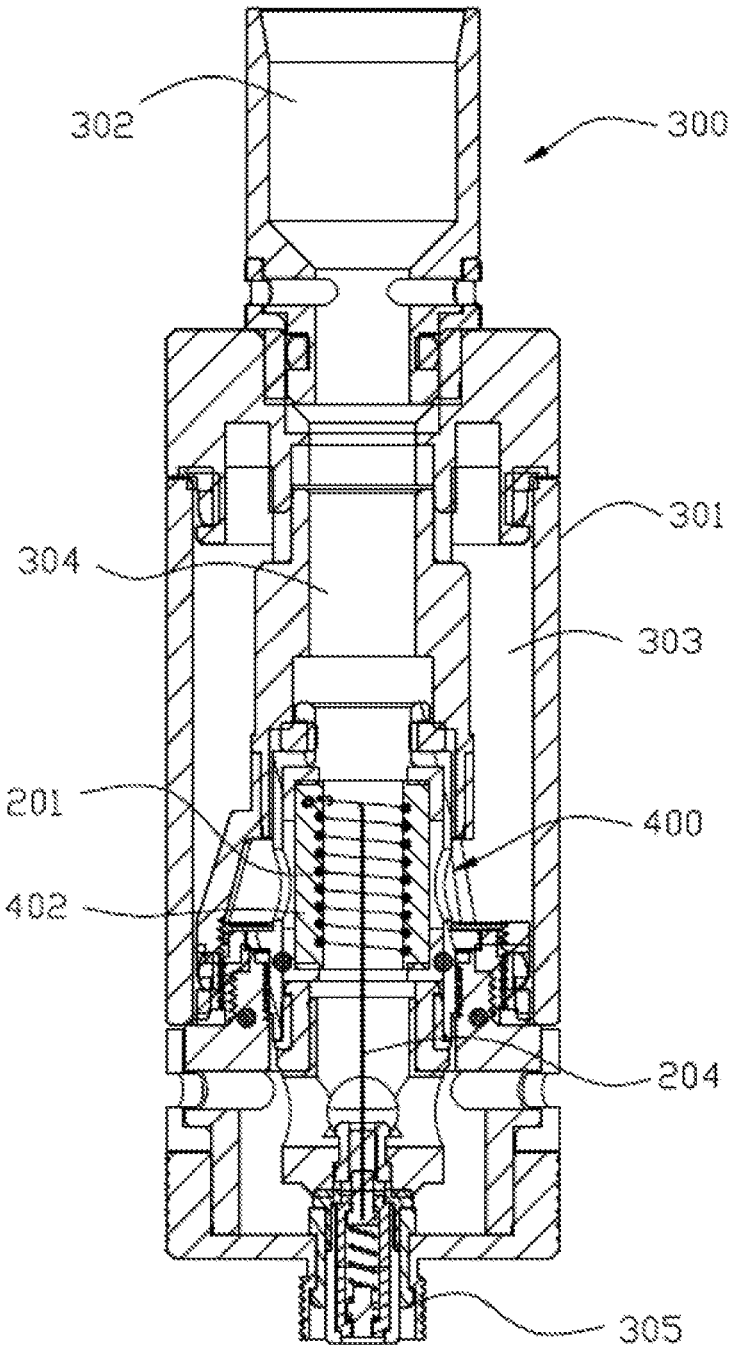
FIG. 6 is a cross-sectional view of an atomizer according to a fourth embodiment.
Figure 7:
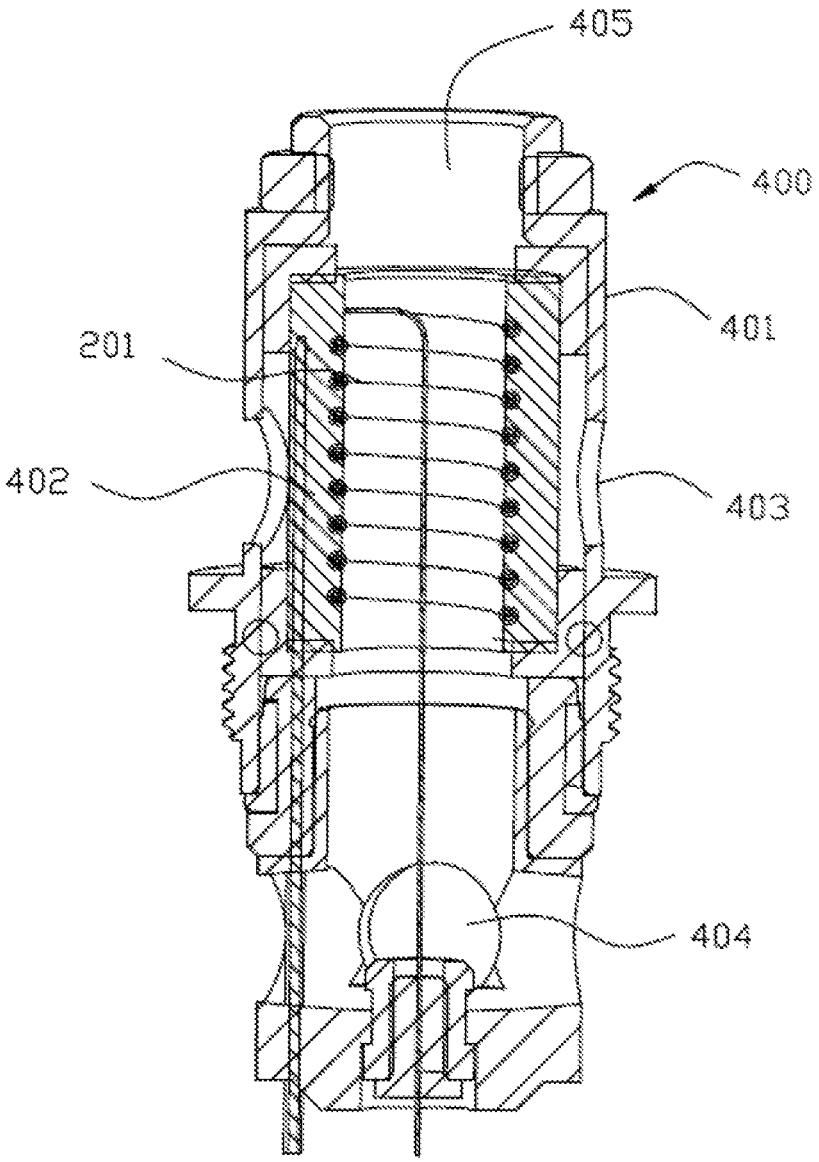
FIG. 7 is a cutaway view of an atomizing unit of the atomizer of FIG. 6.

Referring to FIGS. 6-7, an atomizer 300 for an electronic cigarette is shown. The atomizer 300 includes a housing 301, a mouthpiece 302 connected to the housing 301, and an atomizing unit 400 arranged in the housing 301. The housing 301 defines a liquid chamber 303 configured (i.e., structured and arranged) for storing tobacco liquid. The atomizing unit 400 includes the heating device 100 or 200. Taking the heating device 200 for an example, the tobacco liquid in the liquid chamber 303 can flow into the atomizing unit 400, and is then heated by the heating device 200 to form aerosol. An air passage 304 is connected between the atomizing unit 400 and the mouthpiece 302. The aerosol can be expelled via the mouthpiece 302 through the air passage 304. An electrode assembly 305 is provided at a bottom part of the housing 301. The first conductive part 202, the second electrode part 203, and the signal end 204 are connected to the electrode assembly 305.

Quite usefully, the atomizing unit 400 further includes a liquid conducting body 402 in contact with the heating part 201. The liquid conducting body 402 is configured for absorbing tobacco liquid from the liquid chamber 303, and providing the heating part 201 with the tobacco liquid. In the present embodiment, the liquid conducting body 402 is made of porous ceramic or cellucotton. The liquid conducting body 402 is arranged in an internal chamber of a main body 401. The main body 401 defines an air inlet 404 at a first end, and an aerosol outlet 405 at an opposite second end. The main body 401 defines a plurality of liquid inlets 403 in a sidewall. The tobacco liquid in the liquid chamber 303 can reach and permeate the liquid conducting body 402 via the liquid inlets 403.

In the present embodiment, both of the liquid conducting body 402 and the heating device 200 are arranged vertically. The liquid conducting body 402 surrounds the heating part 201. An axial direction of the heating part 201 is coaxial with an axial direction of the liquid conducting body 402.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heating device for an electronic cigarette, comprising:

a heating part, the heating part having a hollow metallic tube wound in a spiral form, an inner tubal passageway being formed in the hollow metallic tube and extending in the same spiral form as the metallic tube, and an outer passageway being formed via being surrounded by the spiral metallic tube;

a first conductive part electrically connected to a first end of the metallic tube;

a second conductive part electrically connected to an opposite second end of the metallic tube.

2. The heating device according to claim 1, further comprising a temperature sensor arranged in the inner tubal passageway of the heating part, wherein the heating device further comprises an insulating medium filled between temperature sensor and the heating part.

3. The heating device according to claim 2, wherein the temperature sensor comprises two thermocouple wires, the two thermocouple wires are connected with each other in one end, and arranged abreast in the heating part.

4. The heating device according to claim 3, wherein an end of one of the thermocouple wires is connected to the first or the second conductive part, and an end of the other of the thermocouple wires is connected to a signal end; the signal end passes through the metallic tube, and through a hollow space of the outer passageway of the heating part.

5. The heating device according to claim 2, wherein the insulating medium is made of magnesium oxide.

6. The heating device according to claim 1, further comprising a porous ceramic body, wherein the porous ceramic body defines a chamber extending through the porous ceramic body, the heating part is arranged in the chamber, and is sintered with the porous ceramic body integrally.

7. An atomizer for an electronic cigarette, comprising:

a housing, the housing defining a liquid chamber configured for containing tobacco liquid;

a mouthpiece arranged at an end of the housing;

an atomizing unit arranged in the housing;

wherein the atomizing unit comprises the heating device according to claim 1, the tobacco liquid is capable of flowing into the atomizing unit, and is then heated to form aerosol by the heating device.

8. The atomizer according to claim 7, wherein the atomizing unit further comprises a liquid conducting body in contact with the heating part, and the liquid conducting body is configured for absorbing tobacco liquid from the liquid chamber.

9. The atomizer according to claim 8, wherein the liquid conducting body surrounds the heating part.

10. The atomizer according to claim 9, wherein the liquid conducting body is made of porous ceramic or cellucotton.

11. The atomizer according to claim 9, wherein the liquid conducting body and the heating part are coaxially arranged.

12. A heating device for an electronic cigarette, comprising:

a heating part, the heating part having a hollow metallic tube wound in a spiral form;

a first conductive part electrically connected to a first end of the metallic tube;

a second conductive part electrically connected to an opposite second end of the metallic tube; and a temperature sensor arranged in the heating part, wherein the heating device further comprises an insulating medium filled between temperature sensor and the heating part.

* * * * *